US010226862B2

(12) United States Patent
Blake

(10) Patent No.: US 10,226,862 B2
(45) Date of Patent: Mar. 12, 2019

(54) CONVERTIBLE TOOL CASE TO A SUPPORT ASSEMBLY

(71) Applicant: James Francis Blake, Prescott Valley, AZ (US)

(72) Inventor: James Francis Blake, Prescott Valley, AZ (US)

( * ) Notice: Subject to any disclaimer, the term of this patent is extended or adjusted under 35 U.S.C. 154(b) by 0 days.

(21) Appl. No.: 15/887,416

(22) Filed: Feb. 2, 2018

(65) Prior Publication Data

US 2018/0333839 A1 Nov. 22, 2018

Related U.S. Application Data

(63) Continuation-in-part of application No. 15/599,657, filed on May 19, 2017, now Pat. No. 9,918,568.

(51) Int. Cl.
*B25H 3/02* (2006.01)
*A47F 5/00* (2006.01)
(Continued)

(52) U.S. Cl.
CPC ..... *B25H 3/023* (2013.01); *A47F 5/0006* (2013.01); *B25H 3/04* (2013.01); *A47B 57/42* (2013.01); *A47B 57/425* (2013.01); *A47B 57/46* (2013.01); *A47B 57/52* (2013.01); *A47B 57/56* (2013.01); *A47B 57/562* (2013.01); *A47B 57/567* (2013.01); *A47B 96/067* (2013.01); *A47F 5/0087* (2013.01); *A47F 5/0093* (2013.01);
(Continued)

(58) Field of Classification Search
CPC .... A47F 5/0807; A47F 5/0838; A47F 5/0081; A47F 5/0087; A47F 5/0093; A47G 25/0692; A47G 25/0678; A47G 25/0685; A47B 96/067; A47B 57/42; A47B 57/425; A47B 57/46; A47B 57/52; A47B 57/56; A47B 57/562; A47B 57/567; B25H 3/023; B25H 3/04
USPC ..... 248/294.1, 304, 308, 215; 211/53, 58, 211/94.01, 94.02, 96, 99, 105.1, 170, 171
See application file for complete search history.

(56) References Cited

U.S. PATENT DOCUMENTS 934,569 A * 9/1909 Quinlan et al. .... A47G 25/0685 211/99
1,706,887 A * 3/1929 Knostman ..... A47B 61/02 211/85.3
(Continued)

FOREIGN PATENT DOCUMENTS

CH 555170 A * 10/1974 ..... A47B 61/003
DE 29510006 U1 * 8/1995 ..... A47F 5/0838
(Continued)

*Primary Examiner* — Eret C McNichols
(74) *Attorney, Agent, or Firm* — Invention To Patent Services; Alex Hobson

(57) ABSTRACT

A position adjustable support assembly is convertible to and from a tool case, to allow transport with a plurality of articles attached thereto. A segmented position adjustable support assembly has a center assembly and a left and right assembly. The left and right assemblies are rotatable about the center assembly and the vertical supports of the center, left and right assemblies can be retained in base and top-receivers of a tool case. Retainers may secure the segmented assembly to the base and top. This allows a user to mount the segmented assembly in a first work location, and then convert the segmented assembly to a tool case for transport to a second work location.

19 Claims, 10 Drawing Sheets

(51) Int. Cl.

| | |
|---|---|
| ***B25H 3/04*** | (2006.01) |
| *A47F 5/08* | (2006.01) |
| *A47G 25/06* | (2006.01) |
| *A47B 57/42* | (2006.01) |
| *A47B 96/06* | (2006.01) |
| *A47B 57/46* | (2006.01) |
| *A47B 57/56* | (2006.01) |
| *A47B 57/52* | (2006.01) |

(52) U.S. Cl.
CPC ..... *A47F 5/0807* (2013.01); *A47F 5/0838* (2013.01); *A47G 25/0678* (2013.01); *A47G 25/0685* (2013.01); *A47G 25/0692* (2013.01)

(56) References Cited

U.S. PATENT DOCUMENTS 2,039,758 A * 5/1936 Wayne ..... A47B 61/02 211/100
2,577,860 A * 12/1951 Schoor ..... A47G 25/0678 211/105.1
2,647,642 A * 8/1953 Kosash ..... A47B 5/04 211/100
3,245,645 A * 4/1966 Dupler ..... A47G 25/0678 248/215
3,976,200 A * 8/1976 Munns ..... B62H 3/12 211/100
4,037,727 A 7/1977 Kunkle
4,146,204 A * 3/1979 Thalenfeld ..... A47F 5/0807 248/220.41
4,316,547 A * 2/1982 Varon ..... A47G 25/0692 211/105.1
4,318,486 A 3/1982 Bobrowski
4,997,148 A 3/1991 Sherman
5,236,095 A * 8/1993 Krizka ..... A47F 5/13 211/102
5,332,108 A * 7/1994 Blass ..... A47B 96/067 211/103
5,452,875 A * 9/1995 Kern ..... A47B 57/045 108/108
5,484,519 A 1/1996 Fenton et al.
5,642,557 A 7/1997 Clews
5,695,078 A * 12/1997 Otema ..... A47B 57/045 108/108
5,752,535 A 3/1998 Sanders
5,857,577 A * 1/1999 Thomas ..... A47B 57/26 211/94.01
6,206,210 B1 * 3/2001 Reed ..... A47F 5/0087 211/168
6,561,474 B1 * 5/2003 Walter ..... A47F 5/0815 211/94.01
6,582,096 B1 * 6/2003 Searer ..... A47B 61/003 211/105.1
6,732,984 B2 * 5/2004 Tsai ..... A47F 5/0006 211/17
7,600,729 B2 * 10/2009 Valin ..... A63B 55/61 248/304
7,861,871 B2 1/2011 Kao
7,931,161 B2 4/2011 Newbould et al.
8,132,277 B2 3/2012 Buchanan
8,348,301 B2 1/2013 Darling, III
9,380,890 B2 * 7/2016 Mustari ..... A47F 5/02
2007/0170130 A1 7/2007 Plzak
2011/0197542 A1 8/2011 O'Toole
2011/0226715 A1 * 9/2011 Schwartzkopf ..... A47B 96/061 211/87.01
2015/0053728 A1 * 2/2015 Womble ..... A47F 5/0838 223/85
2015/0097097 A1 * 4/2015 Early ..... A47G 25/0678 248/215
2015/0189982 A1 * 7/2015 Fitzpatrick ..... A47B 23/043 248/397

FOREIGN PATENT DOCUMENTS

FR 2718000 A3 * 10/1995 ..... A47F 5/0807
FR 2876892 A1 * 4/2006 ..... A47F 5/0056

* cited by examiner

CONVERTIBLE TOOL CASE TO A SUPPORT ASSEMBLY

CROSS REFERENCE TO RELATED APPLICATIONS

This application is a continuation in part of U.S. patent application Ser. No. 15/599,657, filed on May 19, 2017 and currently pending.

BACKGROUND OF THE INVENTION

Background

Support assemblies, especially wall mounted support assemblies typically provide extensions from the wall at fixed locations. Since the types of items to be supported range is sized and shape, the fixed extensions provide limited versatility for supporting various items.

SUMMARY OF THE INVENTION

The invention is directed to a position adjustable support assembly that comprises support extensions that extend from a support frame. The support frame has a pair of vertical support members coupled together by one of more horizontal support members. The support extensions are detachably attachable to the horizontal support members and are positionably adjustable along the length of the horizontal support member. The support extensions are attached to the horizontal support members by an extension attachment that comprises a gap opening that enables the extension attachment to be snapped over the horizontal support member. Any number of extension attachments and support extensions attached thereto may be attached to a horizontal support member.

An extension attachment may be t-shaped, having a support coupler with a length that extends along the length of the horizontal attachment and is configured for detachably attachment to the horizontal support member, and an extension coupler, for attachment of a support extension. The extension coupler may have a length that is orthogonal to the support coupler length, thereby producing a t-shaped extension attachment.

In an exemplary embodiment, the support coupler portion of an extension attachment has a circular inside surface that extends around a rod-shaped horizontal support member. The horizontal support member may further comprise a fin slot for retaining a fin that extends into support extension to prevent it from spinning about the horizontal support member. In an exemplary embodiment, a fin is slidably engaged within the fin slot of the horizontal support member, thereby enabling the fin and a support extension to be positioned along the length of the horizontal support member, as desired. A plurality of support extensions may be attached and detached to a horizontal support member as desired and then slid to a desired position.

A gap between the fins may be large enough to allow an extension attachment to be snapped onto and attached to the horizontal attachment between the fins or between a fin and a vertical support member or a horizontal attachment between a horizontal support member and the vertical support member. The extension attachment may then be slid over a fin, or a fin may be slid along the fin slot into the extension attachment. An extension attachment may have an inner retainer that enhances the attachment to the horizontal member. For example, a sleeve may be inserted into the inner portion of the support coupler to improve the attachment and retention of the extension attachment to the horizontal support member. The inner retainer may be made from a material that is has different properties than the rest of the extension couple, such as being more ductile or alternatively stiffer. For example, the inner retainer may be CPVC and the rest of the extension coupler may be PVC. Poly vinyl chloride (PVC) is a thermoplastic polymer, while CPVC is a thermoplastic produced by the chlorination of the PVC resin. CPVC is significantly more ductile than PVC, thereby allowing greater flexure and crush resistance.

A support coupler of an extension attachment may further comprise a coupler retainer that extend from the extension coupler to the horizontal support member, thereby fixing the extension coupler and support extension in a fixed location along the length of the horizontal support member. The horizontal support member may have a plurality of retainer apertures for receiving the coupler retainer. Likewise, an extension coupler may have a retainer that extends through the extension coupler and into the support extension, thereby preventing the support extension from pulling out from the extension attachment or rotating. An exemplary extension coupler may be a circular shaped aperture for receiving a rod-shaped support extension, or a support extension having a circular cross-sectional outer surface.

An exemplary support frame may be positionably adjustable as well. The horizontal support members may be slid up and down along the length of the vertical support members and retained in position by horizontal attachment retainer that extend into retainer apertures within the vertical support members. A vertical support member may have a plurality of retainer apertures configured along the length of the vertical support member to enable vertical adjustment and fixation of the horizontal support members. A horizontal attachment may couple a horizontal support member to the vertical support member. An exemplary horizontal attachment has a circular aperture for sliding along a rod shaped vertical support member and may have a circular aperture for receiving and retaining the rod shaped horizontal support member. A horizontal attachment may be t-shaped like the extension attachment and may have a gap opening to allow the horizontal attachment to be snapped onto the vertical support member.

An exemplary support frame may be attached to a support surface, such as a wall by one or more brackets. These brackets may comprise a pivot to allow the support frame and position adjustable support assembly to rotate about the pivot, or out and way from the wall. A pair of upper brackets may be configured with a movable engagement feature to allow a pivoting support frame to be locked to upper bracket. The moveable engagement feature may be slid or rotated up to allow the vertical support member to rotate into position to the upper bracket and then the moved down to engage with the vertical support member and lock it into place.

An exemplary extension attachment or horizontal attachment may have a gap opening that extends an effective radius to allow it to be snapped over a rod-shaped member. The extension attachment or horizontal attachment may flex or expand to allow detachable attachment to the rod-shaped member. The ends of the extension that define the gap attachment or horizontal attachment may spread apart and expand and then quickly clamp shut around the rod-shaped member when the extension attachment or horizontal attachment is snapped into place. The gap radius may therefore be about 70 degrees to about 140 degrees, about 80 degrees to about 140 degrees, about 90 degrees to about 140 degrees, about 100 degrees to about 140 degrees, about 110 degrees to about 140 degrees and any range between and including the radius values provided, such as about 80 degrees to about 120 degrees, for example. When the radius of the gap is smaller, it may be more difficult to snap the attachment into location about a rod-shaped member and if the radius is too large, it may not provide adequate retention.

An exemplary position adjustable support assembly may be a segmented position adjustable support assembly, or segmented assembly, having a center position adjustable support assembly, or center assembly, a left position adjustable support assembly, or left assembly and a right position adjustable support assembly, or right assembly. The segmented assembly may be convertible into a tool case, wherein the left and right assemblies are rotatable about the center assembly and wherein the vertical support members are retained in base receivers and top-receivers. The left assembly is coupled to the left side vertical member of the center assembly by a horizontal attachment, which enables the left assembly to rotate about the left side vertical support member. Likewise, the right assembly is coupled to the right side vertical member of the center assembly by a horizontal attachment, which enables the right assembly to rotate about the right side vertical support member. With the left-side and right-side assemblies rotated to a substantially orthogonal orientation to the center assembly, the four vertical support members, left-side, right-side, left extended and right extended can be placed into receivers of the base and top and secured with base and top retainers, respectively, to form a tool case.

The receivers of the base and/or the top may be channels for receiving the second end and first end, respectively, of the vertical support members. The receivers may have an aperture for receiving a retainer, such as a pin, as described herein. The receivers may have automatic attachment means, wherein upon insertion, the vertical support member is locked or attached and will not be released until a release lever or feature is activated. A receiver may be or comprise a latch, such as a spring loaded latch or a living hinge latch. A receiver may comprise a cylinder having a gap opening for receiving the vertical support member. The vertical support member or members, such as the left-extended and/or right extended vertical support members, may be rotated into the gap opening of the latch and snapped into the latch for attachment. An enlarged portion of the vertical support member may prevent the vertical support member from sliding out of the latch when the tool case is moved or lifted. Likewise, the left-side and right-side vertical support members of the center assembly may be snapped into a gap opening of a latch type receiver.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
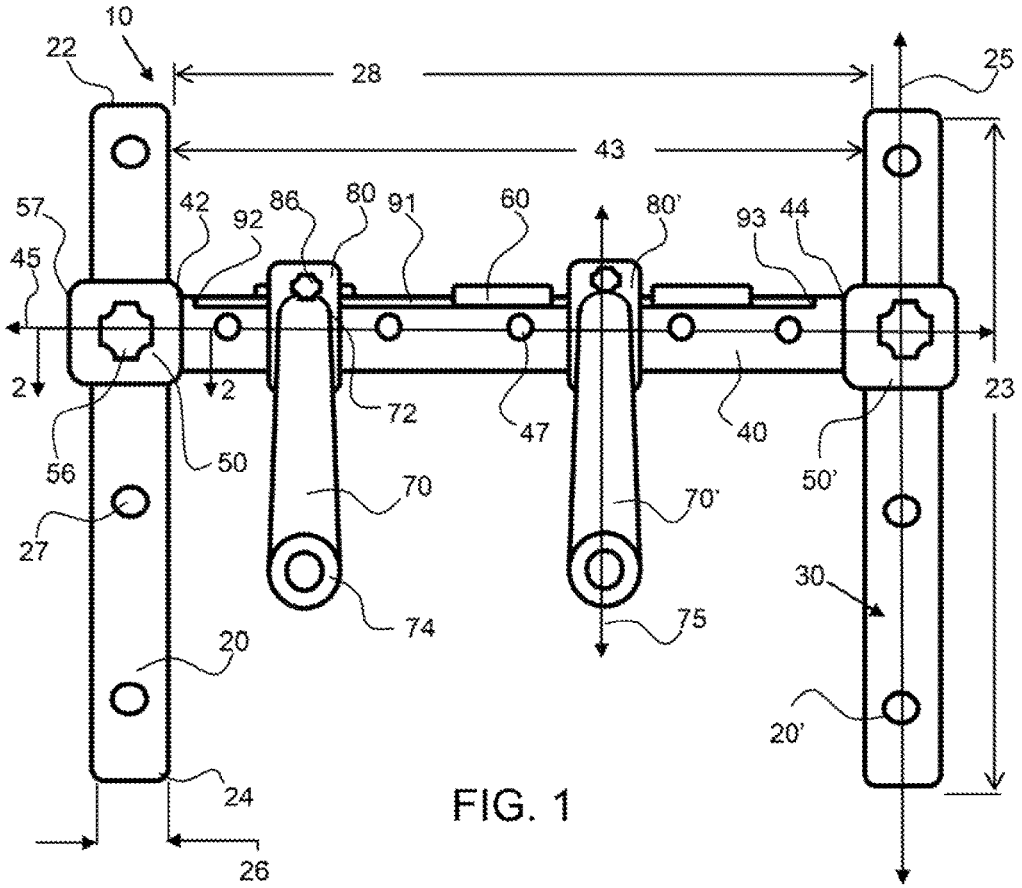
FIG. 1 shows a front view of an exemplary position adjustable support assembly comprising a pair of vertical support members having a horizontal support member extending therebetween. A pair of support extension are attached to the horizontal support member by an extension attachment.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
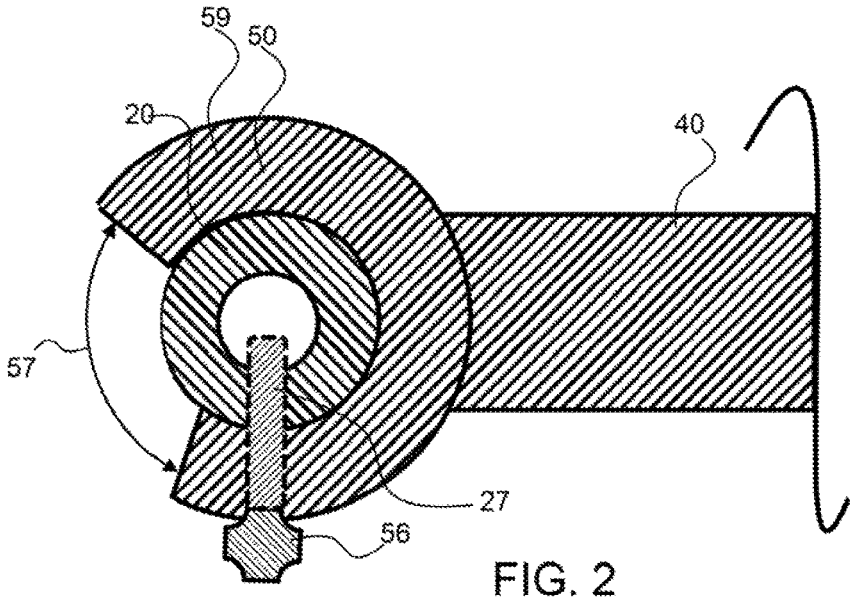
FIG. 2 show a cross-section view of a horizontal attachment coupled to a vertical support member.

Referring to FIGS. 1 and 2, an exemplary position adjustable support assembly 10 comprises a support frame 30 comprising a pair of vertical support members 20, 20' having a horizontal support member 40 extending therebetween. The two vertical support members are space apart by an offset distance 28. A pair of support extension 70, 70' are attached to the horizontal support member by extension attachments 80, 80'. The vertical support members have a length axis 25 that extends along the length of the vertical support member from the first end 22 to the second end 24. The horizontal support members are attached to the vertical support member by horizontal attachment retainers 57 that extend into the vertical support retainer apertures 27. There are a plurality of vertical support retainer apertures along the length of the vertical support member 23 to allow a user to retain the horizontal support member in desired location along the length of the vertical support member. The vertical support members have a length axis 25 that extends along the length of the vertical support member from the first end 22 to the second end 24. The vertical support member has a width or diameter 26. The horizontal support member is retained by horizontal attachments 50, which may be a semi-circular collar that fits completely around the vertical support members, or a horizontal coupler 59, as shown in FIG. 2, and extends partially around the vertical support member and are retained by the horizontal attachment retainer 57. As show in FIG. 2, the horizontal attachment 50 is extended around the vertical support 20. The horizontal attachment gap 57 allows the attachment to snap around the vertical support member and the horizontal support retainer 56 extends into the retainer aperture 27 of the vertical support to retain the horizontal support in a fixed location on the vertical support member. The horizontal support member 40 may rotate within the horizontal attachment 50 and a set pin or screw 54 may lock the horizontal support member in a rotation position with respect to the vertical support member 20, as shown in FIG. 2.

Figure 3:
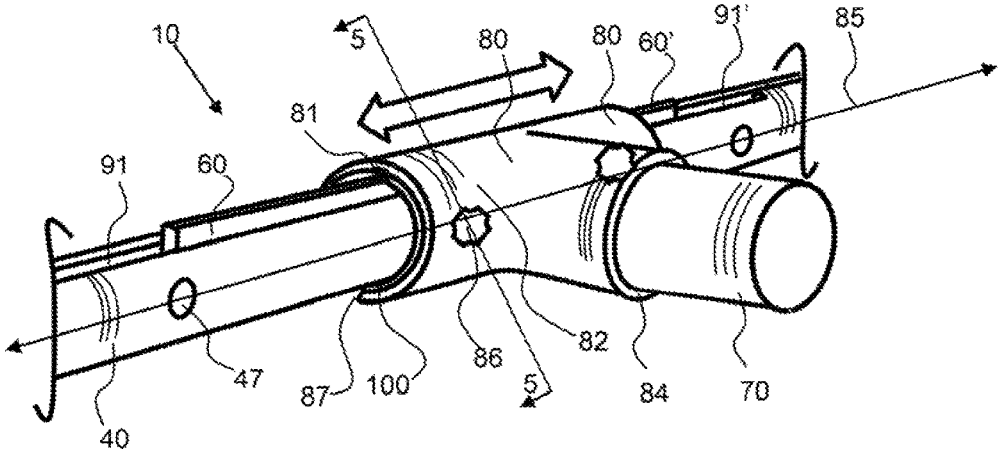
FIG. 3 shows a perspective view of a support extension attached to a horizontal support member by a coupler that snaps onto the horizontal support member and is retained by fin that extends in a fin slot of the horizontal support member and into the retainer slot of the coupler to retainer the coupler in a fixed rotational position to the horizontal support member.
Figure 4:
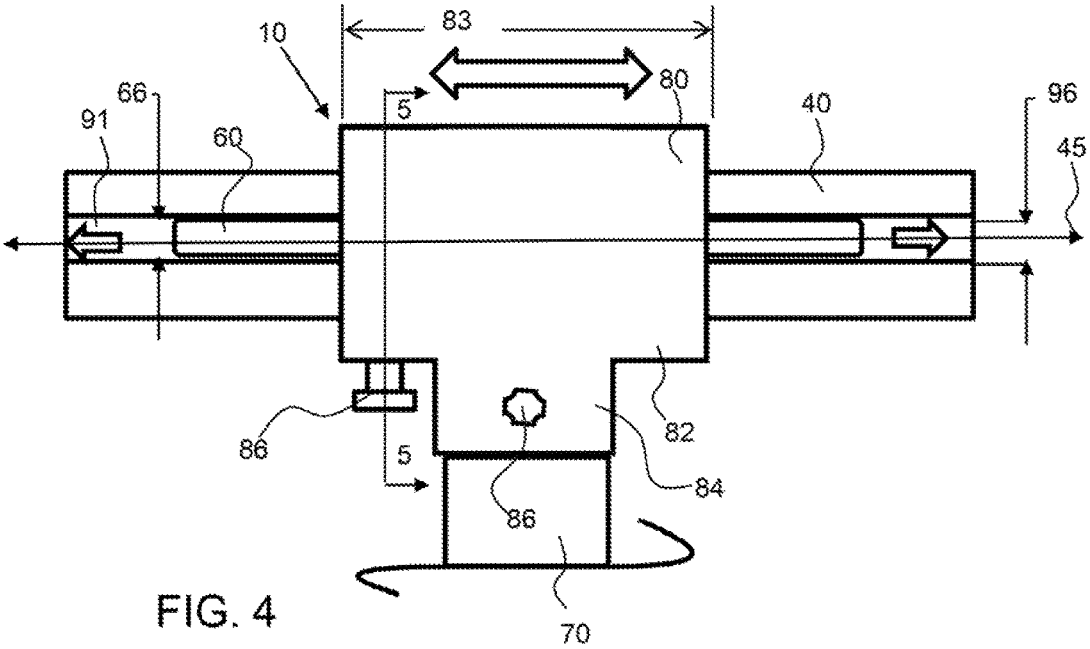
FIG. 4 shows a top-down view of an exemplary coupler attached to a horizontal support member.

Referring now to FIGS. 3 and 4, a support extension 70 is coupled to a horizontal support member 40 by extension attachments 80. The exemplary extension attachment 80 is t-shaped having a support coupler 82 portion having a length 83 and length axis 85 that is parallel with the length axis 45 of the horizontal support member 40, when attached thereto. The support coupler is semi-circular shaped having a gap opening 87 for snapping the support coupler around the horizontal support member. The exemplary extension attachment 80 has an extension coupler 84 portion that extends perpendicularly to the extension coupler portion and has an aperture for receiving the support extension 70. The support extension is inserted into the extension coupler 84 portion of the extension attachment 80 and a retainer 86' may extend through the extension attachment and into the support extension 70.

Referring now to FIGS. 1, 3, 4 and 5, a support extension 70 is coupled to a horizontal support member 40 by extension attachments 80. As shown in FIG. 1, two extension attachments are coupled to the horizontal support member and have a length axis 75 that is perpendicular to the horizontal support member length axis 45. The horizontal support member has a length 43 from a first end 42 to a second end 44. The support extensions have a length from an attached end 72 to an extended end 74. As best shown in FIGS. 3 and 4, the extension attachment 80, or support coupler 82, has a gap opening 87 that allows the support coupler to snap over and onto the horizontal support member 40. A fin slot 91 extends along the horizontal support member and has a length from a first end 92 to a second end 93. The length may be substantially the length of the horizontal support member 40. A fin 60 is retained in the fin slot 91 and can slide within the slot along the length of the fin slot or the horizontal member. The support coupler 82 has a retaining slot 81 that allows a fin to be slid into the support coupler to retain the support coupler in a fixed rotational position with respect to the horizontal support member. The support extension 70 and support coupler 82 may be slid however along the length of the horizontal support member 40, as indicated by the double ended bold arrow. This allows positioning the support extension between the vertical supports as desired. A coupler retainer 86 may be used to fix the support coupler 82 and support extension 70 in a fixed position along the length of the horizontal support member. The horizontal support member has a plurality of retainer apertures 47 along the length of the horizontal support member 40. The fin and the support coupler may be slid together to a desired location. A plurality of fins 60 may be configured within a fin slot 91 and a gap distance between them may allow a coupler to snap onto and attach to the horizontal support member before the fin is located within the retainer slot 81 of the support coupler 82. As shown in FIG. 4, the fin slot 91 has a width 96 that is greater than the width 66 of the fin 60.

Figure 5:
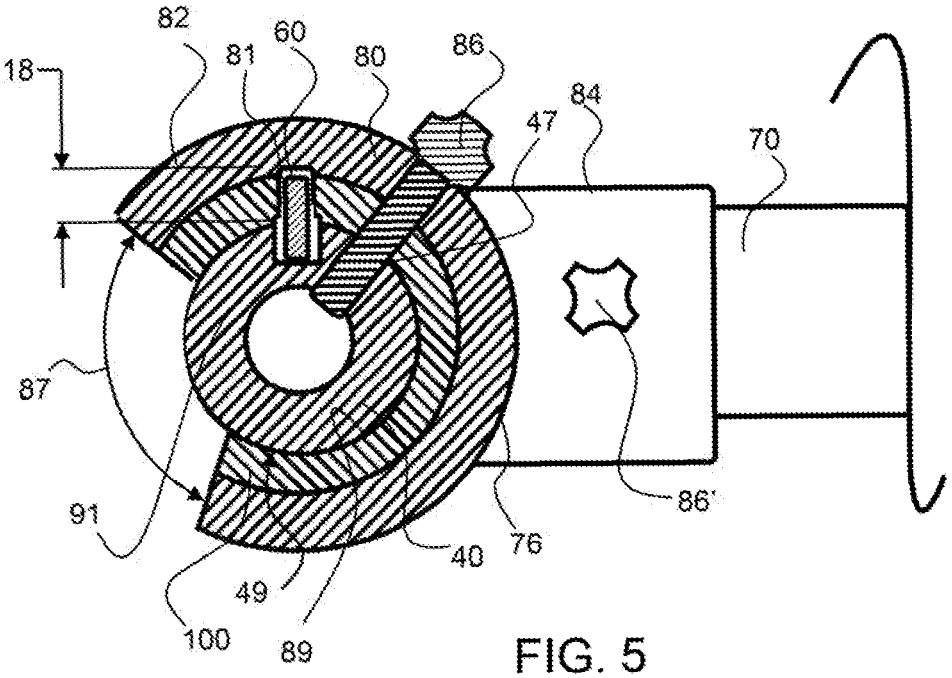
FIG. 5 shows a cross-sectional view of the coupler shown in FIG. 3, along line 5-5.

As shown in FIG. 5, an exemplary coupler 86 is inserted through the wall of the support coupler 82 and into the horizontal support member 40. The fin 60 is shown being configured within the fin slot 91 of the horizontal support member 40 and the retaining slot 81 of the coupler 82. The retaining slot height or depth 18 is shown and extends beyond the inner retainer 100. Also shown in FIG. 5 is the gap opening 87 that extends a radius about the support coupler 82. The inside surface 89 of the support coupler 82 is configured around the outside surface 49 of the horizontal support member. The inner retainer 100 is configured on the inside surface of the support coupler portion of the extension attachment 80. As described herein, the inner retainer may be a different material than the remaining portion of the extension attachment or the support coupler. The retaining slot may extend into or through the inner retainer. The support coupler 82 portion of the extension attachment is concentrically coupled about the horizontal support member 40.

Figure 6:
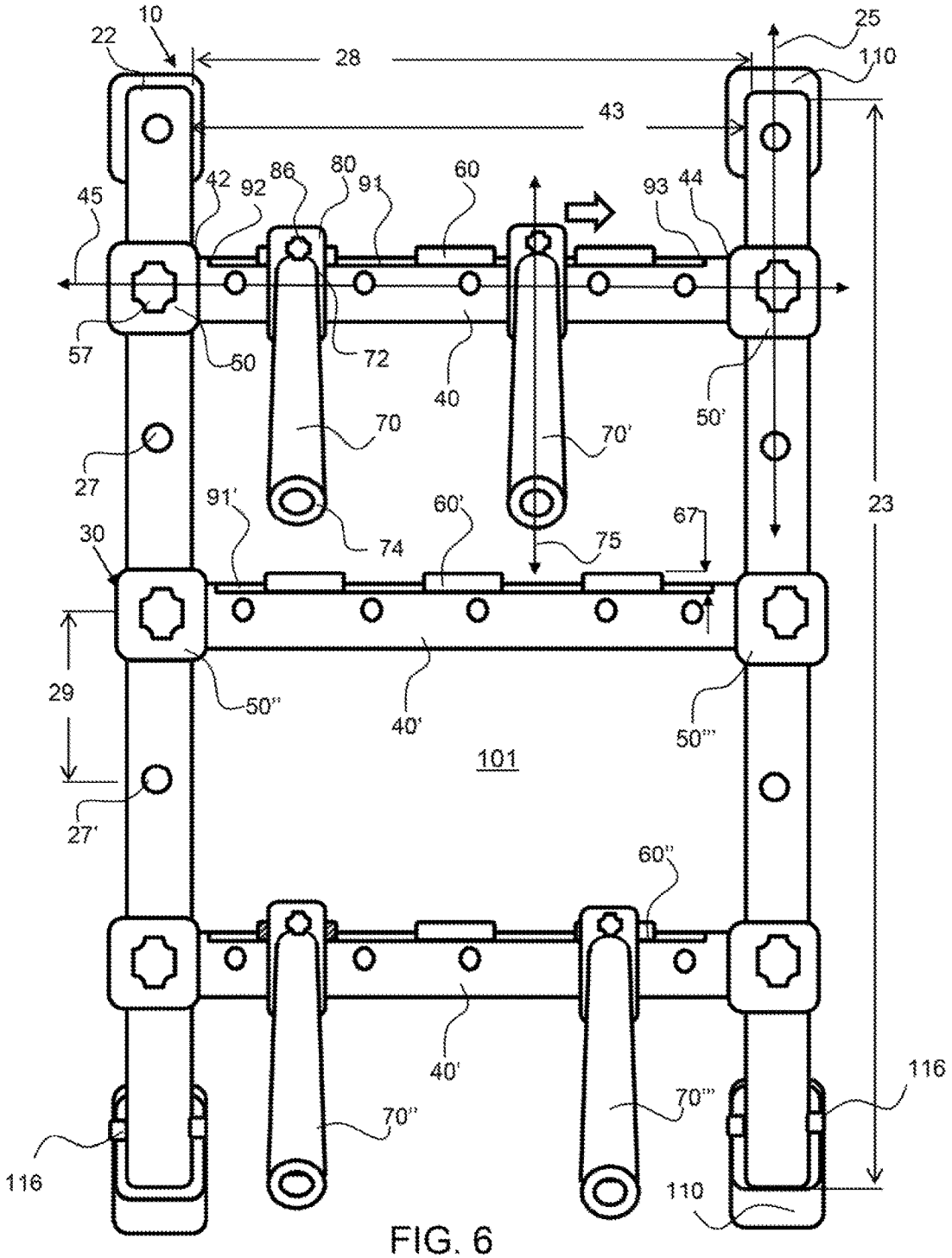
FIG. 6 shows a front view of an exemplary position adjustable support assembly having three horizontal support members that extend between two vertical support members.
Figure 7:
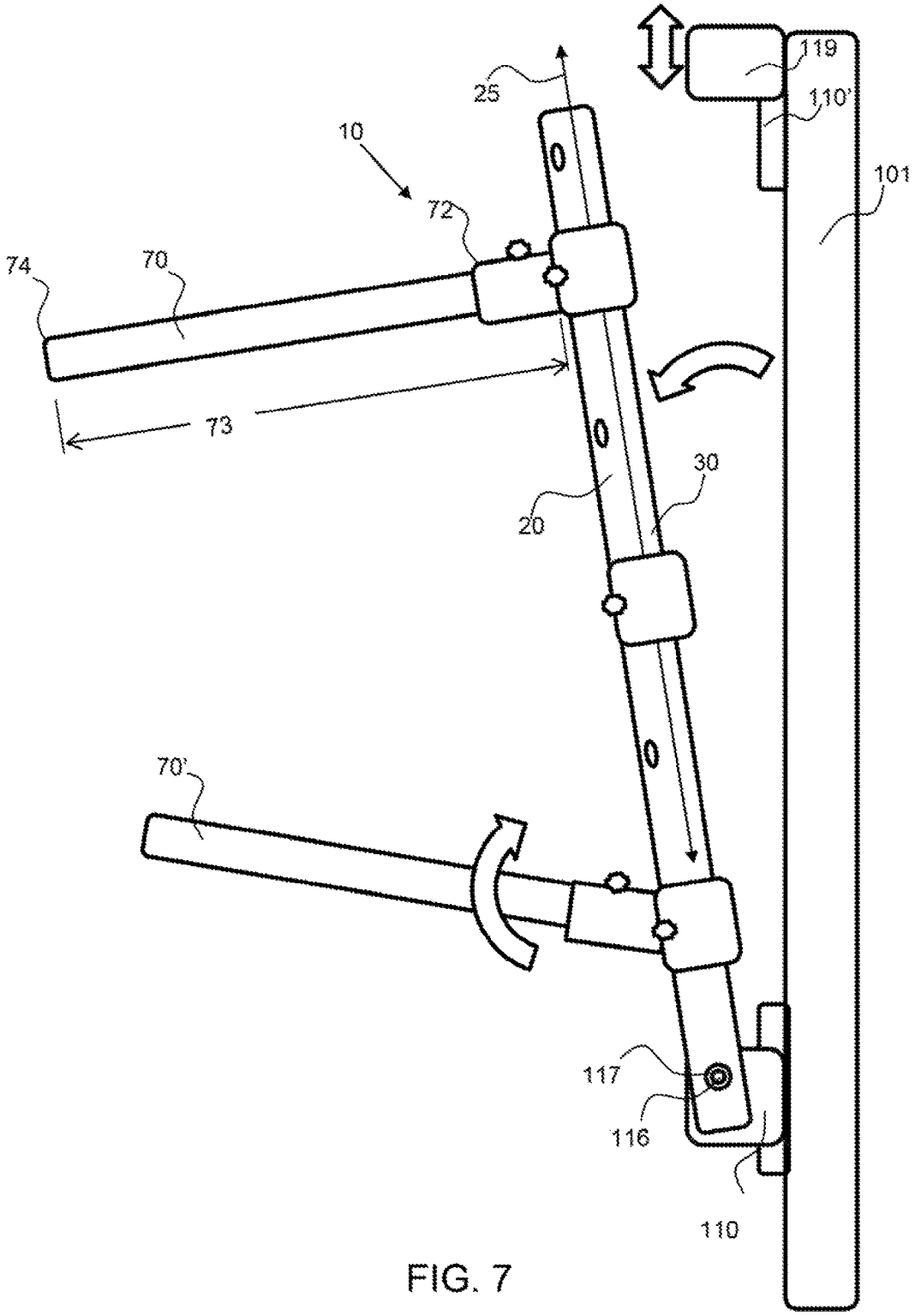
FIG. 7 shows a side view of an exemplary position adjustable support assembly with one of the horizontal support members rotates up and the vertical support members attached to a structure, such as a wall, by a bracket having a pivot.

Referring now to FIGS. 6 and 7, a support frame 30 is coupled to a support surface 101, such as a wall. As shown in FIG. 6, an exemplary position adjustable support assembly 10 has three horizontal support members 40, 40' and 40" that extend between two vertical support members 20, 20'. There are two support extensions 70, 70' attached to the top horizontal support member 40. One of the horizontal support members 70 is retained in a rotational position by a fin 60 and the other horizontal support member 70' has been snapped onto the horizontal support member but a fin has not been slid into the retainer slot of the extension attachment 80. The middle horizontal support extension 40' has a plurality of fins 60 in the fin slot 91' that are offset from each other to produce a fin gap that enables a horizontal support extension to be attached within said fin gap. The fins 60 extend up from the outside surface of the horizontal support members a fin height 67. The bottom horizontal support member 40" has two support extension 70" and 70'" attached thereto. The position adjustable support assembly 10 is coupled to a support, such as a wall, by a bracket 110 and the bracket has a pivot 116 to allow the assembly to rotate away from the wall, as shown in FIG. 7. Also shown in FIG. 7, the bottom support extension 70' is rotated up. The bottom horizontal support member 40" as shown in FIG. 6 may be rotated with respect to the vertical support members and retained in place by a set screw, for example. The support frame 30 is rotated about the pivot 116 in the bottom bracket 110. The upper bracket 110' has a movable engagement feature 119 to allow the support frame 30 to be pivoted back to the wall and then retained by the movable engagement feature. The movable engagement feature may slide or rotate up to allow the support frame to be pivoted into position and then slid down to engage and retain the support frame. In addition, the position adjustable support assembly 10 may be removed from the support surface or bracket by removal of the pin 117 in the lower brackets 110.

Figure 12:
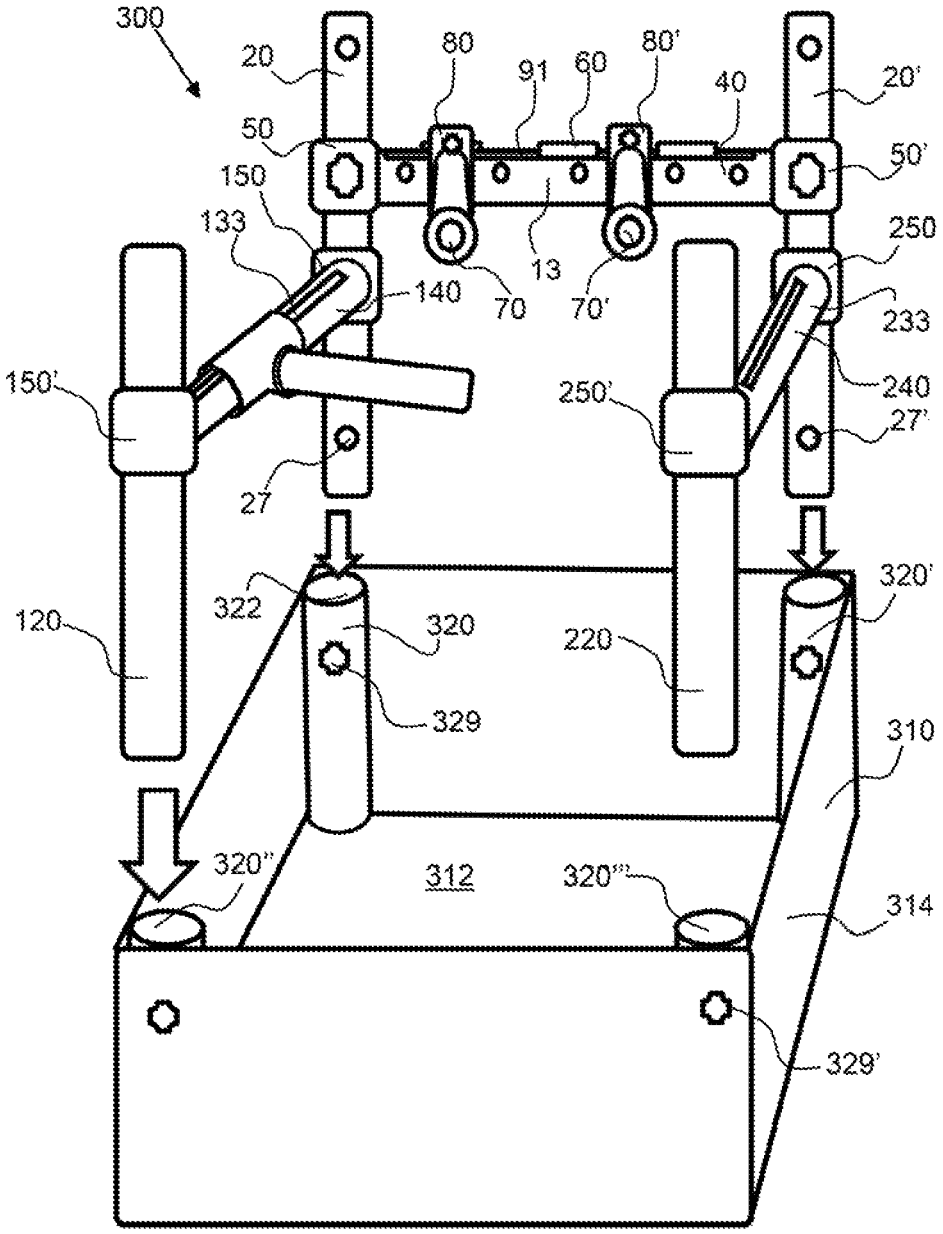
FIG. 12 shows a perspective view of an exemplary segmented assembly configured over a base of a tool case with the vertical members aligned with base receivers.
Figure 13:
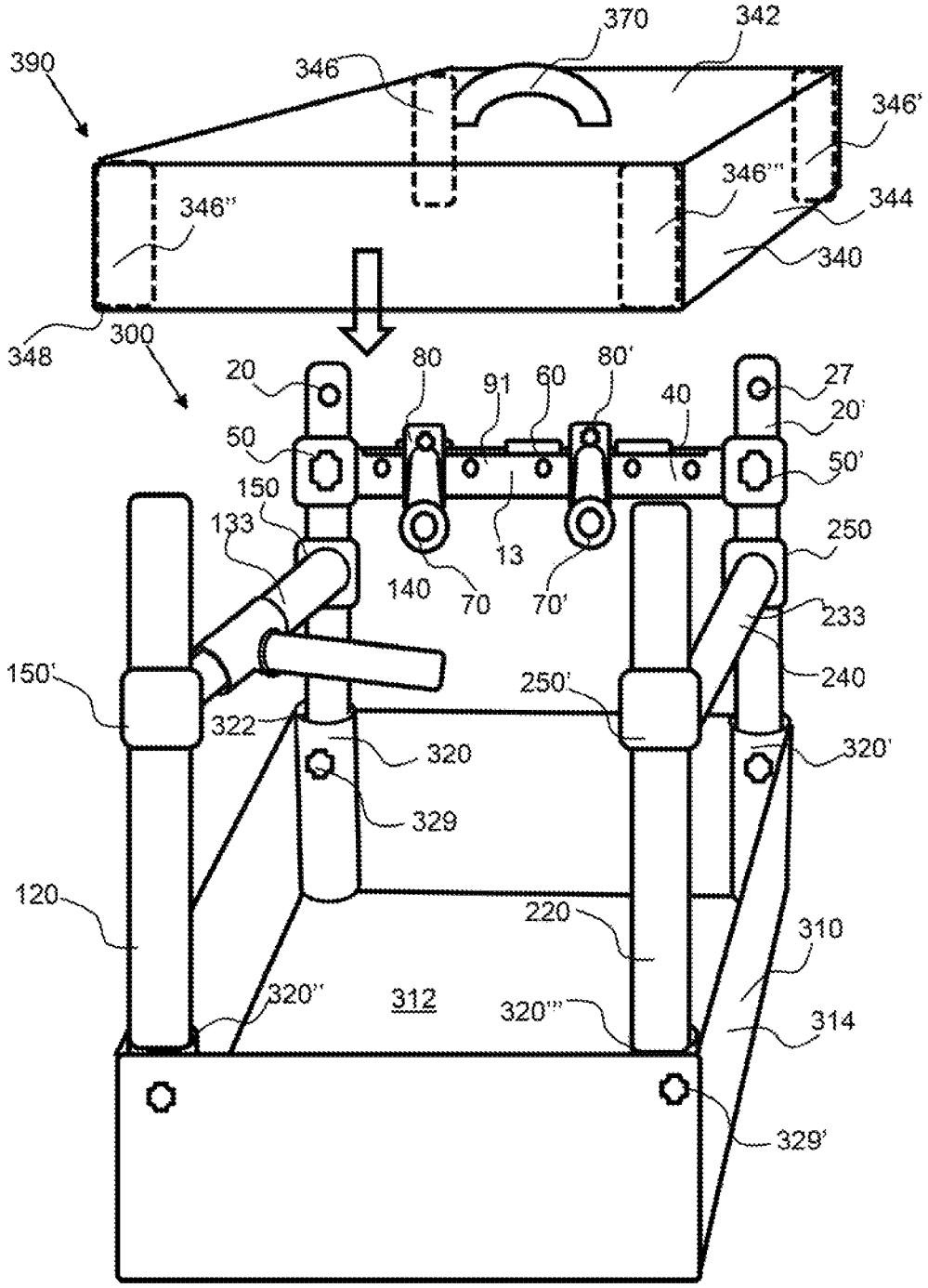
FIG. 13 shows a perspective view of an exemplary segmented assembly configured in and secured to a base of a tool case with the vertical members retained in the base receivers and secured by base attachments, and a tool case top configured over the segmented assembly.
Figure 14:
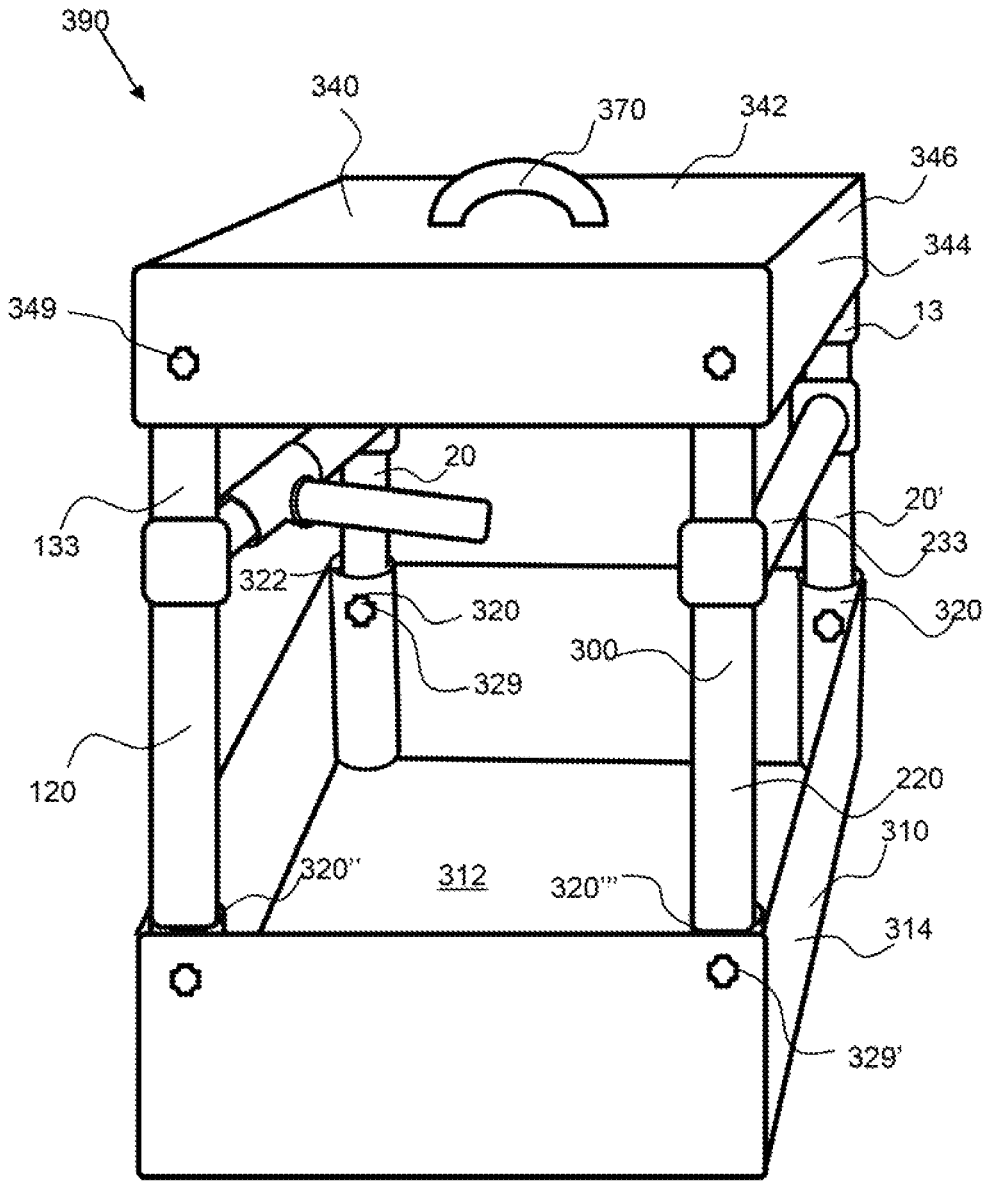
FIG. 14 shows a perspective view of an exemplary tool case comprising a segmented assembly attached between a tool base and a tool top or tool lid, wherein the vertical support members are retained in base receivers and top-receivers.

Referring now to FIGS. 8 to 14, an exemplary segmented assembly has left and right assemblies attached to a center assembly that can rotate about the center assembly. The vertical support members can be retained in a base and top to form a tool case as shown in FIG. 14. The segmented assembly may be coupled to a wall and have any number of tools or articles coupled thereto, and be taken off the wall and converted into a tool case for transport to a secondary location. This enables a user to have quick and easy access to articles in a plurality of locations.

Figure 8:
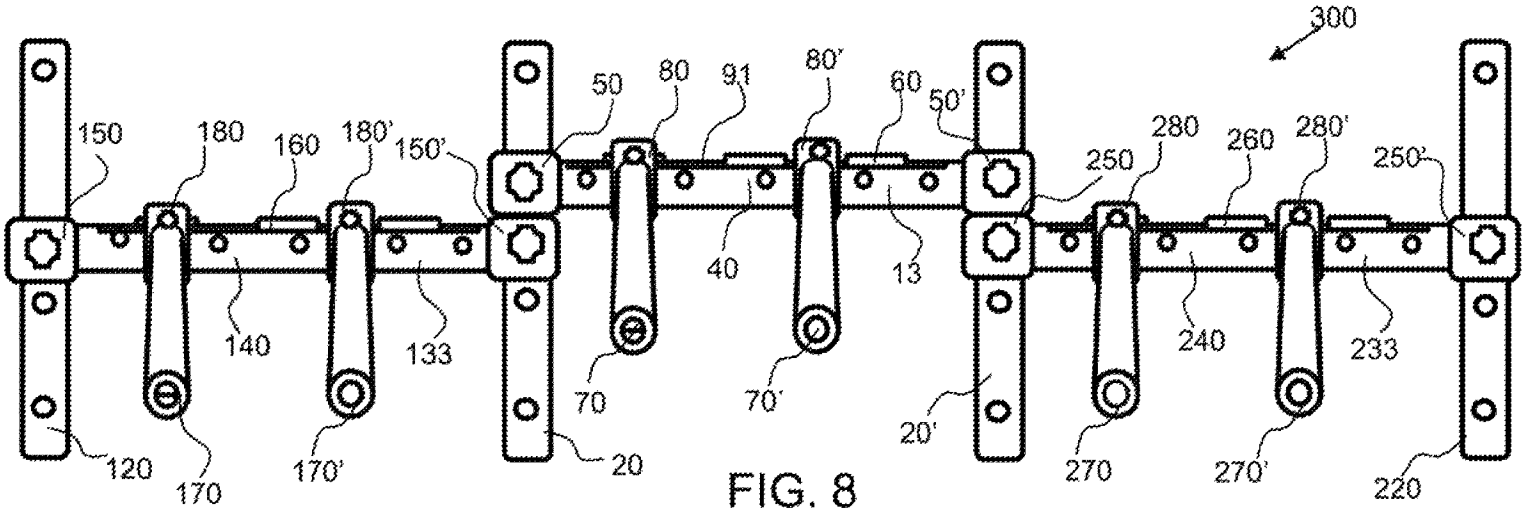
FIG. 8 shows a front view of an exemplary segmented position adjustable support assembly, or segmented assembly, comprising three segments coupled together. A center segmented position adjustable support assembly, or center assembly, has a pair of vertical support members and a horizontal support member extending therebetween. A left and right segmented position adjustable support assembly, or left and right assembly, are attached to left and right vertical support members of the center segment, respectively.

As shown in FIG. 8, an exemplary segmented position adjustable support assembly, or segmented assembly 300, comprises three segments coupled together. A center segmented position adjustable support assembly, or center assembly 13, has a pair of vertical support members 20, 20' and a horizontal support member 40 extending therebetween. A left and right segmented position adjustable support assembly, or left assembly 133 and right assembly 233, are attached to left-side vertical support member 20 and right-side vertical support member 20' of the center segment. The horizontal support members of the left and right assemblies 140, 240, respectively, are coupled to the vertical supports members 20, 20' by horizontal attachment members 150, 250 respectively. The left and right horizontal support members may rotate about the vertical support members. Also note that the left and right assemblies can move up or down with respect to the center assembly by the sliding of the horizontal attachments 150, 250 respectively. The left assembly 133 has a left-extended vertical support member 120 and the right assembly 233 has a right-extended vertical support member 220. The left assembly shares vertical support member 20 with the center assembly 13, and the right assembly shares the vertical support member 20' with the center assembly.

Figure 9:
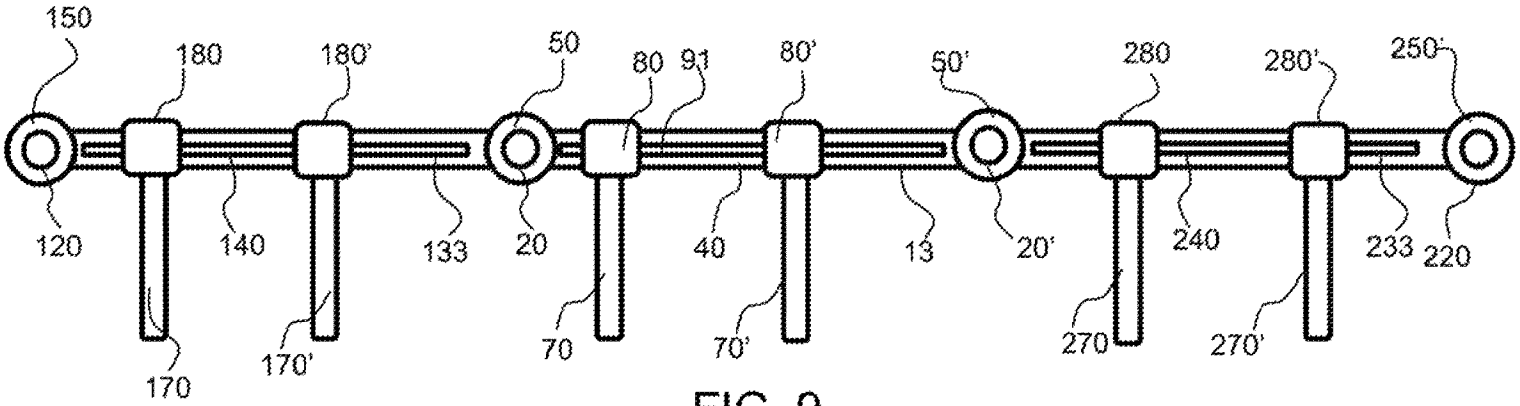
FIG. 9 shows a top view of an exemplary segmented position adjustable support assembly comprising three segments coupled together. A center segmented position adjustable support assembly, or center assembly, has a pair of vertical support members and a horizontal support member extending therebetween. A left and right segmented position adjustable support assembly, or left and right assembly, are attached to left and right vertical support members of the center segment, respectively.

FIG. 9 shows a top view of an exemplary segmented position adjustable support assembly, segmented assembly 300, comprising three segments coupled together. A center segmented position adjustable support assembly, or center assembly 13, has a pair of vertical support members 20, 20' and a horizontal support member 40 extending therebetween. A left and right segmented position adjustable support assembly, or left assembly 133 and right assembly 233, are attached to left and right vertical support members of the center segment, respectively. Each of the center, left and right assemblies has at least one support extension 70, 170, 270, respectively, for retaining and supporting articles. These support extensions can be slid along their respective horizontal support members and held in place by a fin configured in a fin slot. The center assembly has fin 60 and fin slot 91. The left assembly has fin 160 and the right assembly has fin 260, each slidable along the horizontal support members 140, 240 respectively. The fins hold the support extensions in a rotational position with respect to the horizontal support members.

Figure 10:
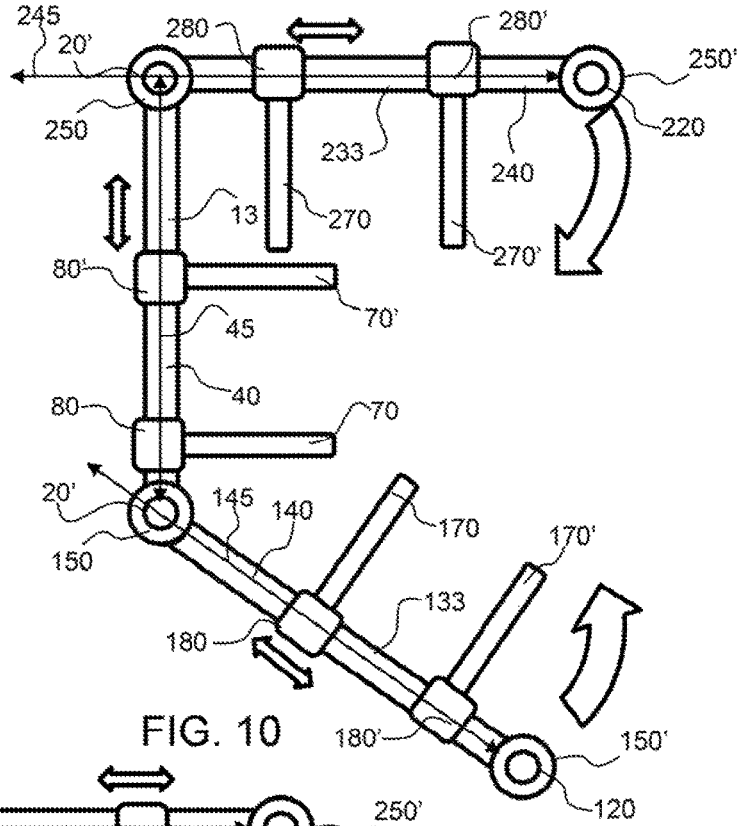
FIG. 10 shows a bottom view of an exemplary segmented position adjustable support assembly with the right assembly rotated to an orthogonal orientation, wherein the length axis of the horizontal member of the right assembly is substantially orthogonal to the length axis of the center assembly, and with the left assembly being rotated to an orthogonal orientation.
Figure 11:
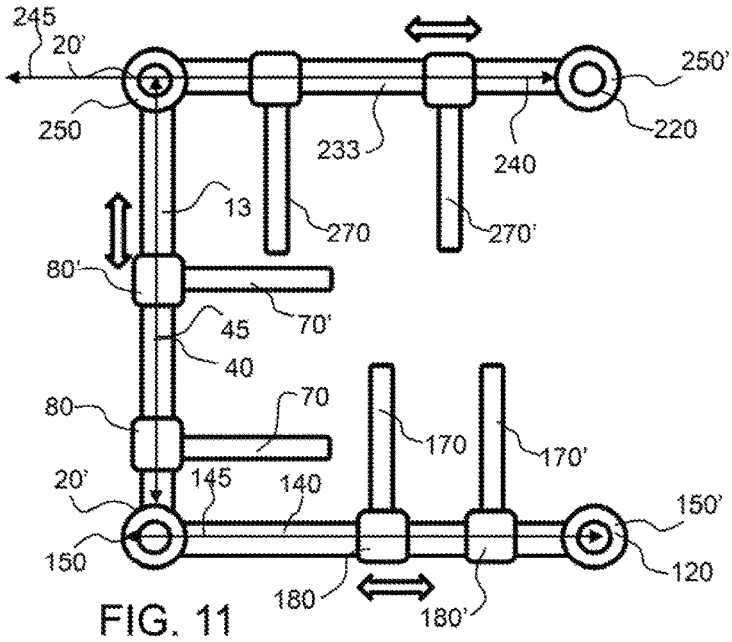
FIG. 11 shows a bottom view of an exemplary segmented position adjustable support assembly shown in FIG. 10 with both the right assembly and left assembly rotated to an orthogonal orientation, wherein the length axes of the horizontal members of the left and right assemblies are substantially orthogonal to the length axis of the center assembly.

Referring now to FIGS. 10 and 11, the left assembly 133 and right assembly 233 are rotatable about the center assembly 13, or rotatable about the vertical support members 20, 20' of the center assembly. As shown in FIGS. 10 and 11, an exemplary segmented position adjustable support assembly 300 is configured with the right assembly rotated to an orthogonal orientation, wherein the length axis 245 of the horizontal support member 240 of the right assembly 233 is substantially orthogonal to the length axis 45 of the horizontal support member 40 of the center assembly 13. As shown in FIG. 10, the left assembly 133 is being rotated to an orthogonal orientation wherein the length axis 145 of the horizontal support member 140 not substantially orthogonal to the length axis 45 of the horizontal support member 40 of the center assembly 13. As shown in FIG. 11, the left assembly 133 is now substantially orthogonal to the center assembly and substantially parallel with the right assembly. The vertical support members, 20, 20' 120 and 220 are now configured in a rectangular orientation, each oriented in a corner of a rectangular shape.

As shown in FIG. 12, an exemplary segmented assembly 300 is configured over a base 310 of a tool case with the vertical support members 20, 20', 120 and 220 aligned with base receivers 320-320'" respectively. Receiver 320 is a left receiver, receiver 320' is a right receiver, receiver 320" is a left-extended receiver, and receiver 320'" is a right extended receiver; referring to the vertical support member they receive. The vertical support members, or the second end of the vertical support members, may be retained in the base receivers and secured by base retainers 329. The base retainers may be configured within the interior of the base 310 or extend through the base to retain the vertical support members. The base receivers may be tubes or form a receiving enclosure of channel for receiving the vertical support members and may have a receiver opening 322 for the insertion of the second end of the vertical support members. The base retainers may extend through the wall of the base receiver and into a retainer aperture 27, 27' of the vertical support member. The base retainer may be a pin, for example, and the pin may have a ball that deflects upon insertion to retain the retainer in place. A release button or feature may allow the ball to deflect for insertion and for removal of the base retainer. The base 310 may comprise a base floor 312 and one or more sides 314 that extend up from the base floor.

As shown in FIG. 13, an exemplary segmented assembly 300 is configured in and secured to a base of a tool case 390 with the vertical support members 20 retained in the base receivers 320 and secured by base retainers 329. A tool case top 340 is configured over the segmented assembly 300. The top comprises a top-cover 342 and a plurality of sides 344 that extend down from the top-cover. The top comprises top-receivers 346, 346', 346" and 346'" for receiving the top of the first end of the vertical support members 20, 20' 120, 220 of the segmented assembly, respectively. The receivers may be tubes, or channels as described for the base receivers and may have an opening 348 for insertion of the first end or, top of the vertical support members. The top may have a handle 370 to allow easy transport of the tool case 390 manually.

As shown in FIG. 14, an exemplary tool case 390 comprises a segmented assembly 300, attached between a tool base 320 and a tool top 340, wherein the vertical support members 20,20' 120, 220 are retained in base receivers 320 and top-receivers 340 and secured by base retainers 329 and top retainers 349, respectively. It is to be understood that the base sides 314 and the top sides 344 may extend and meet or overlap with each other to form an enclosure for the segmented assembly retained therein.

The left and right assemblies may be rotated to be substantially orthogonal to the center assembly as described herein and this includes any angle from about 80 to 100 degrees and for retention in the base and/or top may be 90 degrees.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A tool case comprising:

a) a segmented assembly comprising i) a center assembly comprising:

a left vertical support member; and a right, vertical support member;

a horizontal support member having a length axis and extending between the left vertical support member and right vertical support member;

ii) a left-side assembly rotatably attached to the center assembly and extending from a left end of the center assembly, and comprising:

left-extended vertical support member:

a horizontal support member having a length axis and extending from the left vertical support member to the left-extended vertical support member;

wherein the length axis of the horizontal support member of the left-side assembly extends at, a substantially orthogonal direction to the length axis of the horizontal member of the center assembly;

iii) a right-side assembly rotatably attached to the center assembly and extending from a right end of the center assembly, and comprising:

a right-extended vertical support member;

a horizontal support member having a length axis and extending from the right vertical support member to the right-extended vertical support member;

wherein the length axis of the horizontal support member of the right-side assembly extends at a substantially orthogonal direction to the length axis of the horizontal member of the center assembly, wherein the length axes of the horizontal support members of the left-side and right-side assemblies extend to the same side of the center-assembly;

iv) a support extension coupled to and extending substantially perpendicular to at, least one of the horizontal support members of the center, left-side or right-side assemblies, wherein said support extension comprises:

an attached end that is coupled to said horizontal support member;

an extended end that is extended out aid horizontal support member;

a length from said attached end to said extended end;

an extension attachment attaching the attached end of the support extension to the horizontal support member;

b) a base having a plurality of base-receivers:

c) a top having a plurality of top-receivers:

wherein the left, right, left-extended and right extended vertical supports are retained in the plurality of base receivers and top-receivers to form the tool case.

2. The position adjustable support assembly of claim 1, wherein at least one of said horizontal support members of the center, left-side and right-side assemblies is a position adjustable support assembly, wherein at least one of said horizontal support members of the center, left-side and right-side assemblies comprises a fin slot that extends along the length axis of the support member; and wherein the positional adjustable support assembly further comprises a fin extending perpendicularly a fin height from an outside surface of said horizontal support member and extending a portion of said length of the horizontal support member;

wherein said horizontal support, member has a circular cross-section and wherein the extension attachment comprises a semi-circular support coupler comprising:

a length extending a length axis that is parallel with the horizontal support member length axis;

a gap opening extending along the length axis of the semi-circular support coupler to allow the semi-circular support coupler to extend around the horizontal support member in a concentric coupling arrangement:

an inside surface;

a retaining slot extending along the inside surface along the length axis of the semi-circular support coupler a slot depth;

wherein the slot depth is at least as large as the fin height;

wherein the retaining slot is configured over the fin to secure the support extension to the horizontal support member and prevent rotation about said horizontal support member; and wherein the support extension is detachably attachable to the horizontal support member and position adjustable along the length of the horizontal support member.

3. The position adjustable support assembly of claim 2, wherein the gap opening extends a radius of no more than about 120 degrees.

4. The position adjustable support assembly of claim 2, wherein the gap opening has a radius that is less than the diameter of the horizontal support member, thereby requiring flexing of the semi-circular support coupler to engage around the horizontal support member.

5. The position adjustable support assembly of claim 2, comprising a plurality fins within the fin slot and a gap between two adjacent fins that is larger than the length of the semi-circular support coupler and wherein said semi-circular support coupler is detachably attachable to the horizontal support, member with said gap between adjacent fins.

6. The position adjustable support assembly of claim 2, wherein the horizontal support member comprises a plurality of retainer apertures for receiving a coupler retainer that extends from the semi-circular support coupler into one of said plurality of retainer apertures to retain the support coupler to the support member in a fixed location along the length of the support member.

7. The position adjustable support assembly of claim 1, wherein the plurality of base-receivers comprise:

i) a left vertical support receiver for receiving the left vertical support member;

ii) a right vertical support receiver for receiving the right vertical support member;

iii) a left -extended vertical support receiver for receiving the left-extended vertical support member; and iv) a right-extended vertical support receiver for receiving the right-extended vertical support member.

8. The position adjustable support assembly of claim 7, wherein at least one of the plurality of base-receivers is a channel, and wherein a second end of a vertical support member is inserted into said channel.

9. The position adjustable support assembly of claim 7, wherein at least two of the plurality of base-receivers is a channel and wherein a second end of a vertical support member is inserted into said channel.

10. The position adjustable support assembly of claim 7, wherein at least one of the plurality of base-receivers is retained to the base by a base-retainer.

11. The position adjustable support assembly of claim 1, wherein the top-receivers comprise:

a) a left vertical support receiver for receiving the left vertical support member;

b) a right vertical support receiver for receiving the right vertical support member:

c) a left -extended vertical support receiver for receiving the left-extended vertical support member; and d) a right-extended vertical support receiver for receiving the right-extended vertical support member.

12. The position adjustable support assembly of claim 11, wherein at least one of the plurality of top-receivers is a channel and wherein a first end of a vertical support member is inserted into said channel.

13. The position adjustable support assembly of claim 11, wherein at least two of the plurality of top-receivers is a channel and wherein a first end of a vertical support member is inserted into said channel.

14. The position adjustable support assembly of claim 11, wherein at least one of the plurality of top-receivers is retained to the top by a top-retainer.

15. The position adjustable support assembly of claim 1, where the support extension is detachably attachable to the horizontal support member.

16. The position adjustable support assembly of claim 15, wherein the extension attachment comprises an extension coupler for detachably attaching the support extension by insertion of h attached end of h support extension into the extension coupler.

17. A method of converting the tool case of claim 1 to a wall mounted segmented assembly comprising the steps of:

a) removing the top from the segmented assembly, b) removing the base from the segmented assembly;

c) rotating the left-side assembly until the length axis of the left-side assembly horizontal support member is substantially parallel with the length axis of the center-assembly;

d) rotating the right-side assembly until the length axis of the right-side assembly horizontal support member is substantially parallel with the length axis of the center-assembly;

e) attaching the segmented assembly to a wall.

18. The method of claim 17 wherein the top comprises a top-retainer for retaining at least one of the left, right, left-extended and right extended vertical supports to said top and wherein the method further comprises the step of removing said top-retainer before removing the top from the segmented assembly.

19. The method of claim 17 wherein the base comprises a base-retainer for retaining at least one of the left, right, left-extended and right extended vertical supports to said base and wherein the method further comprises the step of removing said base-retainer before removing the base from the segmented assembly.

* * * * *